United States Patent [19]

Riegler et al.

[11] Patent Number: 4,896,896

[45] Date of Patent: Jan. 30, 1990

[54] SAFETY SKI BINDING

[75] Inventors: Andreas Riegler; Karl Stritzl, both of Vienna; Hurbert Würthner, Hainburg, all of Austria

[73] Assignee: TMC Corporation, Switzerland

[21] Appl. No.: 73,682

[22] Filed: Jul. 15, 1987

[30] Foreign Application Priority Data

Jul. 15, 1986 [AT] Austria ..... 1915/86

[51] Int. Cl.[4] ..... A63C 9/081

[52] U.S. Cl. ..... 280/618; 280/636

[58] Field of Search ..... 280/617, 618, 607, 636

[56] References Cited

U.S. PATENT DOCUMENTS

| | | | |
|---|---|---|---|
| 3,900,205 | 8/1975 | Sittmann | 280/618 |
| 3,937,480 | 2/1976 | Korger | 280/618 |
| 4,600,213 | 7/1986 | Sedlmair et al. | 280/618 |

FOREIGN PATENT DOCUMENTS

| | | |
|---|---|---|
| 330632 | 7/1976 | Austria . |
| 2051758 | 4/1972 | Fed. Rep. of Germany . |
| 2804986 | 8/1979 | Fed. Rep. of Germany . |
| 3342155 | 5/1985 | Fed. Rep. of Germany . |

*Primary Examiner*—David M. Mitchell
*Assistant Examiner*—Michael Mar
*Attorney, Agent, or Firm*—Finnegan, Henderson, Farabow, Garrett & Dunner

[57] ABSTRACT

The invention relates to a safety ski binding having a foot plate that can be swivelled but not lifted, wherein the foot plate in the rear area is held in a running position by a locking member that can be moved against the tension of a spring, the locking member engaging in a holding member. The mounting of the foot plate on a pivot enables a slight displacement in vertical direction.

According to the invention, the foot plate is provided on a section extending between the pivot and a heel grip with a guide element a bent terminal area of which extends into a locating point of a mounting plate affixed to the ski. Another essential element of the invention is the fact that the front area of the foot plate bearing a front jaw is coupled to a guide plate which can be moved, in guide rails of a base plate, in the direction of the ski axis but cannot be lifted vertically.

8 Claims, 2 Drawing Sheets

FIG. 2.
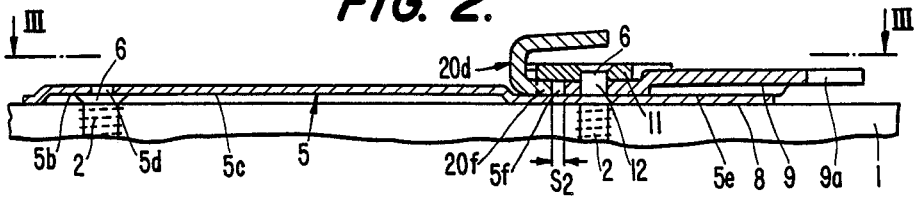
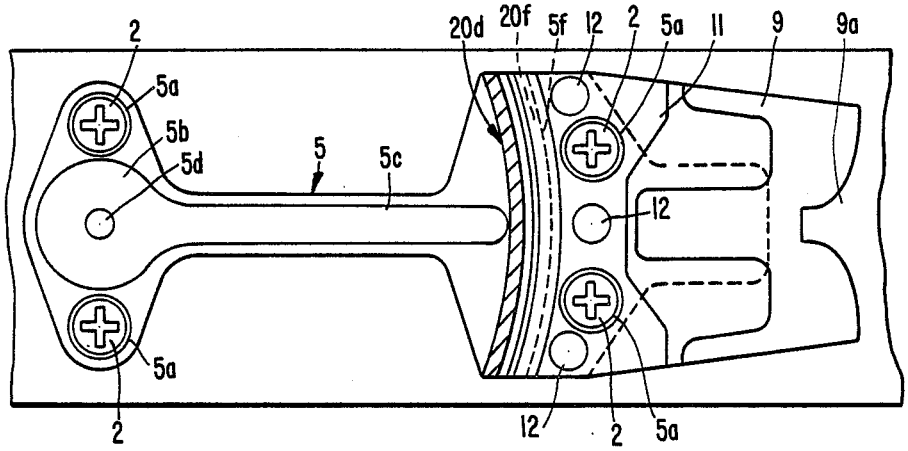
FIG. 4.
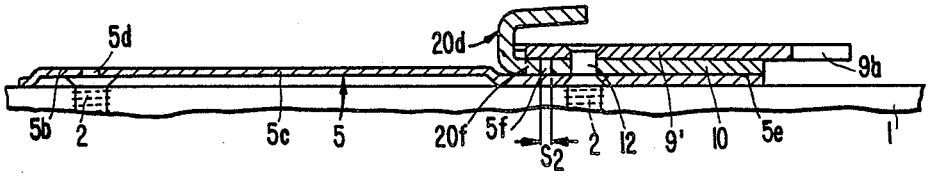
FIG. 5.
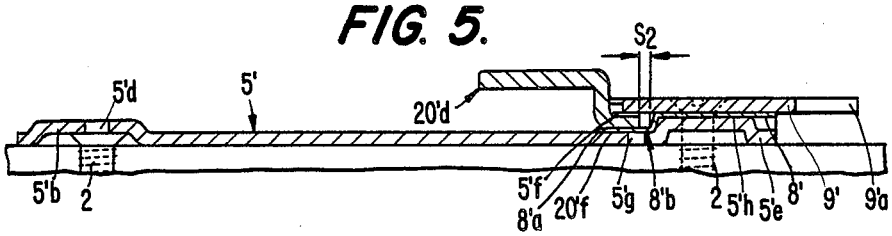
FIG. 6.
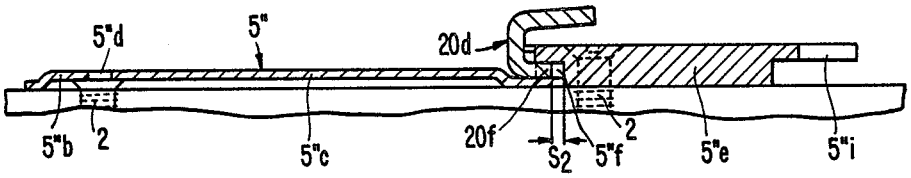

SAFETY SKI BINDING

FIELD OF THE INVENTION

The invention relates to a safety ski binding and more particularly, to a safety ski binding having a foot plate that can be swivelled but not lifted. The rear of the foot plate is held in an operating position by a locking member that can be moved against the tension of a spring.

BACKGROUND OF THE INVENTION

Such a ski binding is basically described in Austrian Patent AT-PS No. 330,632. In one approach, the locking member is so designed that it ensures the control of a heel grip both in the case of the application of excessive lateral forces, and upon the occurrence of excessive forces acting in a vertical plane. As a result, the front jaw of the ski binding can be constructed as a simple fixing bracket, so that in the front area of the foot plate the holding device for the ski boot can be formed very simply. On the other hand, the device of known construction has the disadvantage that it is difficult to determine the varying forces necessary to cause the lateral and the vertical release, since the dimensions of the holding device that locks the control member on the ski is limited due to the available space dimensions. For this reason, it was not possible to carry into practice the technical solution to a problem known for many years.

This type of binding is also known from Published West German Patent Application DE-OS No. 28 04 986. However, in this ski binding, the front and rear areas of the foot plate are mounted on holding elements of the same base plate. This is disadvantageous in that, because of terrain-induced ski deflections, undesirable tensions may occur in the ski and the ski binding.

For the sake of completeness, reference is made to Published West German Patent Application DE-OS No. 33 42 155. In this approach, a single spring is used for the lateral and vertical release, so that compromises in the design and in the mounting are required. In this connection, this design is more remote than that above mentioned.

SUMMARY OF THE INVENTION

An object of the present invention is to provide a particularly advantageous mounting for a safety ski binding, in which the tension in the ski is concomitantly reduced to a practically negligible extent.

Another object of the present invention is to provide a mounting for a safety ski binding which is manufactured as one unit so as to facilitate mounting of the binding on the ski.

Because the foot plate of the binding is supplied with the base plate as one unit, which also includes the front jaw and the heel grip, and this unit is delivered preassembled by the factory to the mechanic, the binding can be mounted without further manipulation after mounting holes have been drilled in the ski.

To achieve these and other objects, and in accordance with the purpose of the invention, a safety ski binding comprises support means aligned along a longitudinal axis, the support means including a base plate, a mounting plate spaced from the base plate and a foot plate extending between the base plate and mounting plate. Pivot means are disposed along the mounting plate for swivelling the foot plate about a first bearing point and for supporting the mounting plate. A front jaw member is securely mounted on the base plate and is biased to limit movement in a substantially perpendicular direction away from the foot plate. A heel holder and cam means are mounted on the support means. Locking means urge the heel grip into engagement with the cam means and control the swivelling movement of the foot plate. Guide means are disposed along the foot plate for guiding movement of the foot plate relative to the mounting plate.

BRIEF DESCRIPTION OF THE DRAWINGS

Other features, advantages and details of the invention will be described with reference to the accompanying drawing which shows, by way of example, embodiments, in which:

FIG. 2 shows a magnified view of the rear area of FIG. 1;

FIG. 3 is a top view of FIG. 2; partially in section along the line III—III of FIG. 2, and FIGS. 4, 5 and 6 show various constructions of the rear area of the ski binding of the invention in longitudinal section, in which only those parts are shown that differ from the first embodiment.

DESCRIPTION OF THE PREFERRED EMBODIMENT

Figure 1:
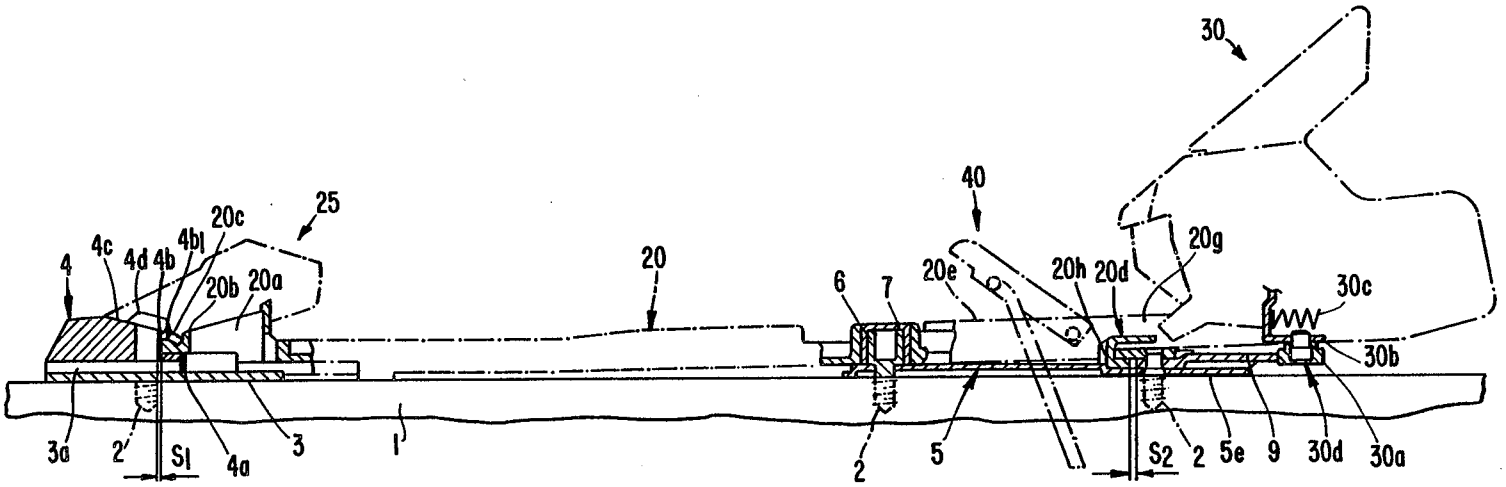
FIG. 1 shows the ski binding incorporating the invention in longitudinal section.

FIG. 1 shows a complete safety ski binding on a ski 1 to be described in detail hereinafter. The parts shown by the dashed lines do not constitute the subject matter of the invention and are shown merely to facilitate an understanding of the operation of the ski binding.

There are attached to the ski 1, by means of screws 2, a base plate 3 for a front jaw 25 and a mounting plate 5 for a foot plate 20 installed by means of its recess to pivot about a vertical axis on a pin 6. The foot plate 20 also bears a heel grip 30 and a ski brake 40, both of known construction, but which do not constitute the subject matter of the invention and are therefore not described in detail herein.

The base plate 3 has on both sides upwardly projecting guide rails **3*a* which extend in the direction of the ski axis. On the base plate 3 is mounted a longitudinally displaceable, but not liftable, guide plate 4, with the lateral parts 4*a* of the guide plate 4 clasping around or crossing under the guide rails 3*a* of the base plate 3. On the shoe-side end portion of the guide plate 4 is a guide slot 4*b* running parallel to the top side of the ski perpendicularly to the longitudinal axis thereof. The guide slot 4*b* has on its front end an upwardly directed enlargement $4b_1$. On the top side of the guide plate 4 is formed a downwardly and rearwardly inclining guide surface 4*c*. A control lug 4*d* rises in the area of the longitudinal axis of the guide surface 4*c***.

The front area of the foot plate 20 is formed as a bearing block **20*a* for the front jaw 25 shown merely in phantom herein. The front terminal area of the bearing block 20*a* is formed as a shoulder 20*b* and its cross section has a shape of a laterally inverted horizontal L. The shoulder 20*b* of the bearing block 20*a* engages the guide slot 4*b* in the guide plate 4, and an upwardly projecting part 20*c* of the shoulder 20*b* extends into the enlargement $4b_1$ of the guide slot 4*b*. A slight play $S_1$ exists between the upwardly projecting parts 20*c*** and the enlargement $4b_1$.

As shown in FIGS. 2 and 3, the mounting plate 5 which is fixed to the surface of ski 1 by screws 2, has holes 5*a* for the screws 2. The the mounting plate 5 has an elevated area 5*b* with a bearing point 5*d*, aligned with the axis of a pivot 6, with the elevated area 5*b* under certain circumstances extending in the direction to the end portion of the ski, thus forming a rib 5*c*.

The pivot pin 6 is non-detachably anchored in the bearing point 5*d* of the mounting plate 5 and bears the foot plate 20 by means of an elastic sleeve 7. In this embodiment, the sleeve 7, fixedly inserted into a recess in the foot plate 20, consists of a low-friction plastic material which permits the tipping of the foot plate 20 in relation to the pivot 6, without the risk of jamming. A polyacetal plastic, such as Delrin, is suitable as plastic.

The rear terminal area 5*e* of the mounting plate 5 includes a locating area or opening 5*f* for the foot plate 20. For this purpose, it supports, under certain circumstances by means of a slide plate 8 of a material with a low friction coefficient, a guide plate 9 and a holding rail 11 which is in engagement with rearwardly bent part 20*f*. Holding rail 11, guide plate 9, and slide plate 8 are non-detachably connected to the rear area 5*e* of the mounting plate 5, e.g., by means of rivets 12. The rear area of the guide plate 9 is formed as a cam 9*a* for the foot plate 20 and cooperates with a locking member 30*d* connected to the heel grip 30. The locking member 30*d* includes a steering roll 30*a* which, by means of its mount 30*b*, is propped up against a spring 30*c* of the heel grip 30 urging it against the cam 9*a* and serves to control the swivelling motion of the foot plate 20. A guide or holding element 20*d*, having in this embodiment a substantially U-shaped cross section, is fixedly connected to the foot plate 20 in a section 20*e* extending between the pivot 6 and the heel grip 30 on the underside thereof.

As embodied herein, the foot plate 20 may be hollowed out to provide a section 20*g* extending in the direction of the ski axis, in which case the subsection of the guide element 20*d* attached to the foot plate 20 projects into a cavity 20*h* of the foot plate 20 and is anchored therein. Rearwardly bent part 20*f* of the guide element 20*d* engages the locating area or opening 5*f* of the mounting plate 5. As is apparent from FIG. 3, the locating area 5*f* of the mounting plate 5 and the guide element 20*d* are designed as circular arc sections so as to enable the foot plate 20 to execute a swivelling motion with certainty. A slight play $S_2$ exits between the guide element 20*d* and the front end of the guide plate 9 and the holding rail 11 in order to prevent jamming of these components during any ski deflection.

The embodiment depicted in FIG. 4 corresponds essentially to that described above, except the holding rail is formed by the front area of the guide plate 9'. An intermediate plate 10 brings the guide plate 9' to the desired height for engagement with portion 20*f*. Connection to the mounting plate 5 and coupling to the foot plate 20 via the guide element 20*d* occur in the same manner as described above.

FIG. 5 shows a third form of construction of the ski binding incorporating the present invention. Here, the mounting plate 5' is formed at its rear end 5'*e* as another elevated area 5'*h*. In addition, the mounting plate 5' has at least one recess 5'*g* for anchoring a slide plate 8' made from a low-friction material. For this purpose, a rounding-off 8'*b* of the slide plate 8' extends into the recess 5'*g*. A forwardly extending extension 8'*a* of the slide plate 8' serves as a base for the guide element 20*d*'. The guide element 20*d*' has a substantially Z-shaped cross section and crosses with its rearwardly bent terminal area 20*f*', in the same manner as previously described, under the front area of the guide plate 9' formed as a holding rail.

FIG. 6 shows another embodiment of the ski binding of the invention, in which the guide plate and the holding rail are formed integrally with the mounting plate 5'' which serves to hold down portion 20*f*. As described earlier, the foot or sole plate 20 in this case is likewise coupled via the guide element 20*d*. In this embodiment as well, the cam 5''*i* for the foot plate 20 is also formed on the mounting plate 5''.

Because the foot plate 20 is coupled to the mounting plate 5, 5', 5'' in the manner described above, it is possible to assemble the whole ski binding at the factory in the ready-to-fit state, and thereafter to mount the ski binding on the ski in the preassembled state. It is also possible to adjust the release parameters even before the mounting the binding on the ski, without causing an improper adjustment during the mounting. For easier assembly, suitable bores for the screws 2 may also be provided in a generally known manner in the foot plate 20 and in the front jaw 25.

The invention is not limited to the embodiments shown. There are other modifications which fall within the scope of protection. For example, the foot plate may be provided with an known adjusting mechanism for longitudinal adjustment. It would also be possible to form the guide plate integrally with the support plate.

What is claimed:

1. A ski binding, comprising:

a base plate;

a mounting plate spaced from said base plate along a longitudinal axis;

a foot plate extending between and at least partially above said base plate and said mounting plate;

pivot means disposed on said mounting plate for swivelling said foot plate about an first bearing point and for supporting said foot plate;

a guide plate positioned above said mounting plate and secured thereto, said guide plate having a rearward edge defining a cam surface;

a slide plate made from a low friction material and positioned between said mounting plate and said guide plate;

a guide element having one end extending between said mounting plate and said guide plate and an opposite end spaced above said mounting plate;

a front jaw member securely mounted on said foot plate and biased to limit movement in a substantially perpendicular direction away from said foot plate;

a heel holder adapted to be mounted on said foot plate; and locking means adapted to be mounted on said foot plate for urging a roller mounted on said heel holder into engagement with said cam surface and for controlling the swivelling movement of said foot plate.

2. The binding as set forth in claim 1, wherein said guide element includes a bent terminal area which crosses under a locating point defined by said mounting plate.

3. The binding as set forth in claim 1, wherein said guide plate has a holding rail integrally formed therwith and is supported by a top side of said mounting plate.

4. The binding as set forth in claim 1, wherein said slide plate is bent downwardly at a right angle, thereby forming a downwardly bent portion which extends into a recess of said mounting plate and secures said slide plate against a swivel movement relative to said mounting plate and wherein said slide plate comprises a forwardly extending section for supporting the guide element.

5. The binding as set forth in claim 2, wherein said foot plate is provided with a cavity extending in the longitudinal direction of the ski, said cavity being positioned such that said guide element extends into said cavity.

6. The binding as set forth in claim 2, wherein said guide element is substantially Z shaped when viewed in the longitudinal direction.

7. The binding as set forth in claim 1, wherein said mounting plate includes holes into which fastening screws are inserted, said fastening screws being accessible by means of access bores provided in said foot plate.

8. The binding as set forth in claim 2, wherein said bent terminal area is positioned at a predetermined distance from said foot plate in the longitudinal direction of the ski.

* * * * *